US005214803A

United States Patent [19]

Shichman

[11] Patent Number: 5,214,803

[45] Date of Patent: Jun. 1, 1993

[54] SMOKE HOOD

[76] Inventor: David Shichman, 93 Arleigh Rd., Great Neck, N.Y. 11021

[21] Appl. No.: 804,088

[22] Filed: Feb. 19, 1992

[51] Int. Cl.[5] ..... A42B 1/04

[52] U.S. Cl. ..... 2/202; 2/71; 2/74

[58] Field of Search ..... 2/7, 202, 205, 171, 2/174

[56] References Cited

U.S. PATENT DOCUMENTS

| | | | |
|---|---|---|---|
| 2,436,249 | 2/1948 | Clement | 2/174 |
| 2,445,487 | 7/1948 | Lester | 2/174 |
| 2,447,561 | 8/1948 | Brenner | 2/174 |
| 2,484,269 | 10/1949 | Carlson | 2/174 |
| 2,546,117 | 3/1951 | Whelan | 2/174 |
| 3,423,763 | 1/1969 | Schwartz | 2/171 |
| 3,562,813 | 2/1971 | Origer | 2/202 |
| 4,502,157 | 3/1985 | Wong | 2/202 |
| 4,554,683 | 11/1985 | Wong | 2/202 |
| 4,583,535 | 4/1986 | Saffo | 2/7 |
| 4,870,959 | 10/1989 | Reisman | 2/7 |
| 5,040,530 | 8/1991 | Bauer | 2/7 |
| 5,101,512 | 4/1992 | Weinstein | 2/174 |
| 5,146,636 | 9/1992 | DeLaPena | 2/202 |

FOREIGN PATENT DOCUMENTS

| | | | |
|---|---|---|---|
| 348052 | 12/1989 | European Pat. Off. | 2/7 |
| 1165524 | 10/1958 | France | 2/202 |
| 2129670 | 5/1984 | United Kingdom | 2/7 |
| 2202151 | 9/1988 | United Kingdom | 2/7 |
| 8202665 | 8/1982 | World Int. Prop. O. | 2/202 |
| 9005565 | 5/1990 | World Int. Prop. O. | 2/205 |

*Primary Examiner*—Clifford D. Crowder
*Assistant Examiner*—Diana L. Biefeld
*Attorney, Agent, or Firm*—Bauer & Schaffer

[57] ABSTRACT

A hood is provided to be worn over the head to protect against smoke and gas. The hood is hermetically sealed on all sides and is provided with an opening into which said head can be introduced. A closure is provided at the opening, so that the hood may be secured substantially airtight about the neck of the wearer.

7 Claims, 2 Drawing Sheets

SMOKE HOOD

BACKGROUND OF THE INVENTION

The present invention relates to apparatus for protecting against the hazards of smoke and other noxious gases.

Fires, chemical spills, toxic fumes, and odors are an ever present danger to the occupants of buildings, factories, mines, or the like, especially when an escape route or exit from the location is not readily available. Various portable devices have been devised to assist an occupant of such an area to escape.

Examples of such prior air survival units are illustrated in U.S. Pat. Nos. 4,502,157; 4,554,683; 3,562,813; and 966,739. U.S. Pat. No. 4,502,157 is broadly directed to a protective enclosure which essentially is pulled taut against the chest of the wearer and secured in this particular position by any fastening means, such that the body of the wearer including, in particular, the wearer's own chest, serves to close the open end of the bag. In short, U.S. Pat. No. 4,502,157 relates to a particular way of draping and supporting a protective enclosure on the user.

U.S. Pat. No. 4,554,683 complements the coverage of U.S. Pat. No. 4,502,157 that it broadly covers a protective enclosure which is designed to have its open end secured about the waist of the wearer and which includes armports through which the wearer inserts his or her arms.

U.S. Pat. No. 3,562,813, which expired on Feb. 16, 1988 describes a protective head enclosure which is essentially a rigid structure and includes cylindrical lower section, an intermediate transparent or window section and an upper hemispherical section.

The expired U.S. Pat. No. 996,739 discloses a protective enclosure which obviously was fabricated from the catagories of materials available in the early 1900's rather than modern day plastics. In all events, the hood or head piece is of an extent such that it drapes against the chest and the back of the wearer and is provided with eye openings which are covered by transparent material.

An objective of the present invention is to provide an improved air survival unit that is compact, inexpensive, and lightweight and which enables the user to breathe normally in a toxic environment for a sufficient period of time to escape therefrom.

Another objective is to provide such an improved survival unit in which the hood is formed of a flame-resistant, transparent plastic film which provides face and eye protection without effective visibility for the user and which provides free mobility to the user because no hookups or connections to sources outside the hood are required. Likewise, no physical obstructions or protrusions violate the integrity of the hood.

Still another objective of the invention is to elimiate the need for an oxygen generator or canister which is inherently unsafe in a fire situation because of the danger of explosion.

A further objective of the invention is to provide such a survival unit in which the length of breathing time provided by the unit may be increased by increasing the size of the hood to accommodate a larger reservoir of air.

A particular objective of the present invention is to provide a protective enclosure particularly designed for use in overcoming the great danger of smoke eminating from a fire in the lower elevation of tall buildings, billowing up to the upper rooms, and choking out the supply breathable life supporting air.

The objects and various other advantages will be seen from the following disclosure of the present invention.

SUMMARY OF THE INVENTION

The present invention may be briefly summarized as providing an improved air survival unit, the general nature of which may be stated as including a transparent lighweight flexible hood adapted to completely cover the head of the wearer including means for sealing the hood tightly about the neck of the wearer to form a generally airtight enclosure.

Preferably, the hood is a clear bag with three closed sides forming a protective bubble enclosure and sealed to have only a single opening that will fit over any persons head, the opening being provided wtih a drawstring to permit quick closing of the bag about the neck of the wearer as well as quick removal.

Full details of the present invention will be seen from the following description and from the accompanying drawings.

DESCRIPTION OF THE INVENTION

Figure 1:
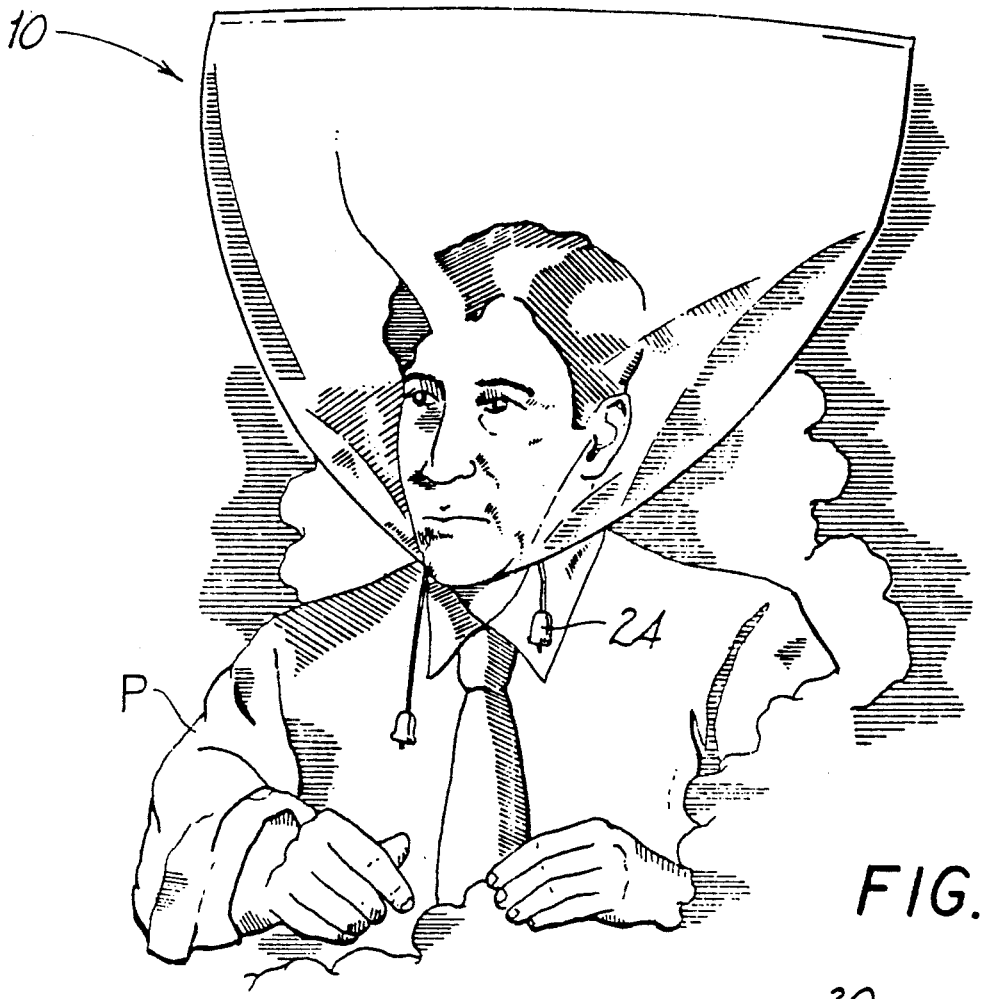
FIG. 1 is a front elevational view illustrating the smoke hood embodying the present invention.
Figure 2:
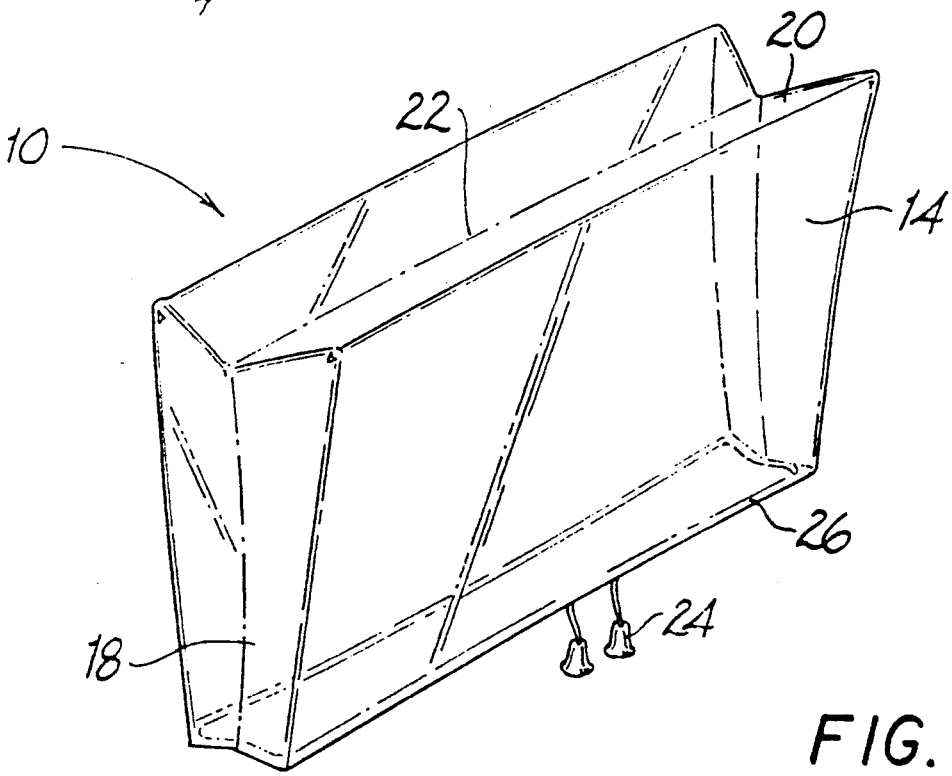
FIG. 2 is a front perspective view illustrating the smoke hood in partially open form.
Figure 3:
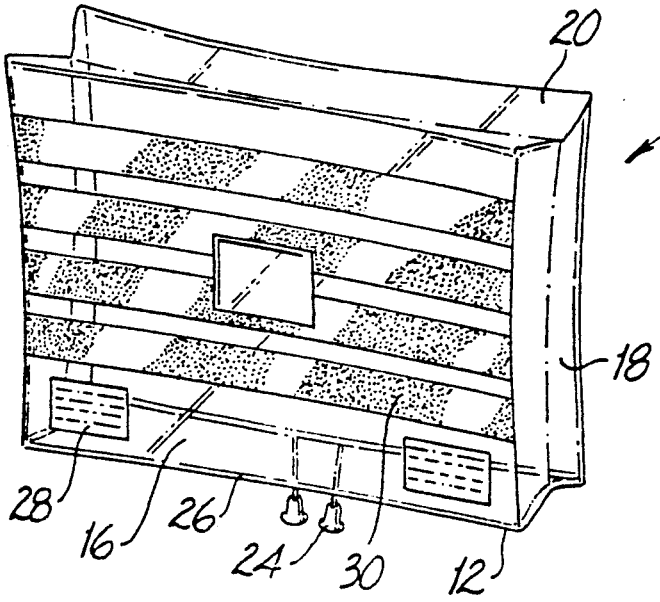
FIG. 3 is a rear perspective view illustrating the smoke hood in partially open form.
Figure 4:
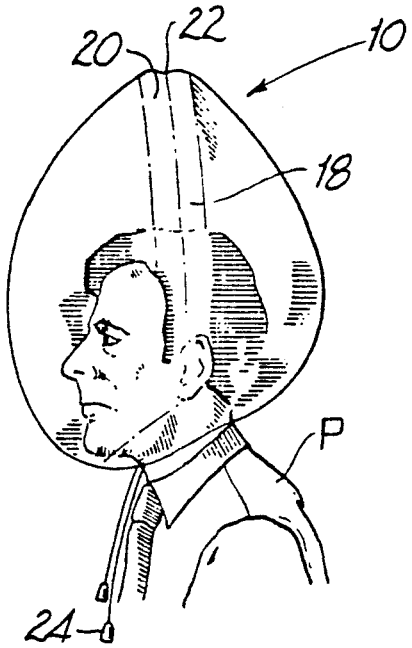
FIG. 4 is a side elevational view illustrating the smoke hood in use on the head of a wearer.
Figure 5:
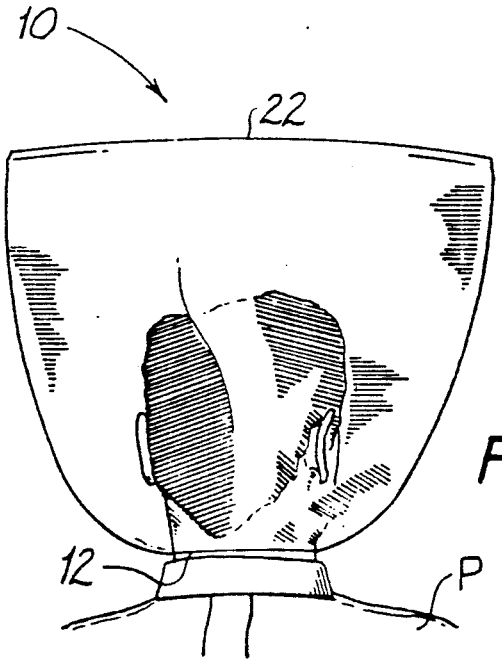
FIG. 5 is rear elevational view illustrating the smoke hood in use on the head of a wearer.

As seen in FIGS. 1–3, the protective device comprises an overly large generally hermetically enclosed flexible hood 10 having an opening 12 at its bottom adapted to be placed over the head of a wearer P. As seen in FIGS. 2 and 3, the hood is formed from a front panel 14 and a rear panel 16 joined integrally in opposed side gussets 18 and a top gusset 20. The shape of the front and rear panels 14 and 16 is not critical but they should have a shape somewhat in the nature of a triangle or a pie wedge so as to be narrower at the open end 12 and quite wide at its upper edge. The periphery of the front and rear panels 14 and 16 are joined (i.e. sealed) by the gussets 18 and 20, which is normally folded along a center line 22 into the front and rear panels but which in use is capable of opening to enlarge the upper end of the hood. Thus, in use, the hood 10 provides an enlarged reservoir for air. The hood is of such size that a substantial portion of the hood exists above the top of the wearer's head to enhance the size of the reservoir.

The opening 12 is of such a size that not only will allow air to easily enter the hood but also permit the wearer to place it over his head. Surrounding the opening is a drawstring 24 having each of its ends extending freely exteriorly of the hood so that they may be easily grasped. The drawstring is slidable with a sleeve 26 formed by integrally securing an elongated strip circumferentially on the exterior of the hood or by providing suitable loops on the surface of the hood to hold the string. The drawstring is thus capable of being closed and tied about the wearer's neck so as to substantially hermetically close the opening.

The hood may be made of any material not porous to smoke or harmful gases. The material is preferably any convenient plastic and should be thin so as to be light in weight and substantially transparent to allow the wearer to see clearly no matter how the hood is placed over the head. As seen in FIG. 3, various indicia can be imprinted on the exterior of the head such as instructions for use 28 and easy recognition bands 30 and the like. Such indicia should be colorful and iridescent to make the wearer easily visible even under heavy smoke conditions.

If desired, the open end may be provided with a reinforcing strip providing a collar. Thus, the drawstring may be secured better and less likely to cut the neck of the user.

The shape of the front and rear panels may be varied as desired, and each may be made of several gores of pieces rather the single piece illustrate. The drawstring may be replaced by a hook and loop fastener such as Velcro or other tie means.

A SPECIFIC CONSTRUCTION

The hood illustrated and described herein may be constructed with the following dimensions and parenthesis. In this form, it is believed to be capable of more or less universal use on all adults and children.

| | | |
|---|---|---|
| Size: | Height | 26" |
| | Top Gusset Width | 4" |
| | Total Height When Fully Opened | 30" |
| | Width | 24" |

Fabric: 3.5 Mil Low Density Polyethylene with Barrier Film, heat sealed on all sides including drawstrings or elastic area.

Neck Closure: Heavy gauge drawstring to tighten hood around neck and resist snagging and knotting.

Printing: Front—Totally Clear Rear—will have printing which will consist of bright fluorescent stripes across the entire back along with logo in the middle off the bag, centered between 2 boxes at bottom.

Box 1—All written disclaimers (for example, for emergency use only, etc.)

Box 2—Both written information and diagrams indicating how to use the smoke hood.

This protective hood will fit over the wearer's head and be seated around the neck and rest on the shoulders to supply a temporary air supply for the wearer to breathe. Depending on the size of the head, this temporary supply will contain enough volume of breathable air to last from 5 to 7 minutes for the normal adult. The volume of this designed hood will have a capacity of 247 pints of air, however a bag of larger dimensions can supply a greater volume and a longer air supply.

It will be seen from the foregoing disclosure that the objective and advantages previously enumerated have been obtained by the present invention. In particular, this invention has created a hood having as tight a seal as possible without becoming uncomfortable, and yet the entire hood is easily donned and removed merely by opening a drawstring closure.

A further advantage of this invention is the additional advantage of being refilled with fresh air in any area of the building that is free from smoke, by merely removing the hood, snapping it once to fill the bag, and then redonning same. While the protective hood will require the intended wearer to hold the open port in order for him to slip it over his neck, it may be removed and swung in any direction to inflate the bag prior to putting the bag over one's head or to reinflate the bag.

The bag may be formed by one or two pieces of nylon, plastic, polyethylene that will be head welded as a seam on top and sides of the bag and will create permanent bond. Gussets on top and on sides may be utilized to maximize air reservoir and to increase the rigidity of the bag to enable to stay erect. A flexible material may be inserted at the seamed edges to further enhance the firm structure keeping it in a preferred upright position.

This present invention has been designed to provide the wearer with a potentially life-saving supply of air for a sufficiently long period of time to escape the hazzards of smoke inhalation without the use of any air canisters or restrictive body enclosures that can restrict the wearer's movements as has been used in prior art. The device is small, compact, portable, and easily carried from one place to another. It is low in cost manufacture.

After the hood is donned, the open side will be closed around the neck by pulling on the drawstrings within the hem on the bottom. This will close the bottom of the hood to a comfortable position around the neck sufficient to keep out any smoke or toxic fumes. The head may easily be removed by loosening the drawstring which holds it taut and lifting the smoke hood of the head.

A smoke hood fabricated from a clear flexible plastic material for use in a toxic environment to provide up to 7 minutes of breathable air for any person subjected to life threatening smoke inhalation or toxic or noxious fumes.

This emergency breathing device, easily donned and removed, having a sealing means about the neck, forms an airtight enclosure which protects the wearer from smoke and fumes while permitting a safe exit from the hazardous area.

This low cost product is ideally suited for use in homes, high rise buildings, hotels, hospitals, schools, factories, planes, and anywhere that the need for fast, safe exit from smoke or fumes is essential for survival. A further advantage lies in the fact that when the device is manufactured, it may be packaged in a small, folded packet, and many of these packets may be stored and maintained in such areas as homes, schools, offices, and the like, in ready access for any emergency.

Seven minutes of breathable air can often means the difference between life and death when attempting to leave a burning building. Eighty percent of all injuries and deaths in fire situations are caused by smoke inhalation. This inexpensive, light, portable product can afford the wearer that difference.

While the above description contains many specificities, these should not be construed as limitations on the scope of the invention but rather as an exemplification of one preferred embodiment thereof. Many other variations are possible. For example, different materials may be used, the size and construction may be altered, other means of closure may be used such as elastic or Velcro, printing may be altered, or colors may be changed. Accordingly, the scope of the invention should be determined not by the embodiment illustrated but by the appended claims and their legal equivalents.

What is claimed is:

1. A protective device against smoke and gases comprises an enlarged hood which may be filled with air and placed over the head of a wearer, said hood being made of material impermeable to air and hermetically sealed on all sides and unitarily integral except for a single opening along one side and closure means in combination with said opening, said hood being collapsible when not in use into a flat airless packet and distendible by manipulation to allow ambient air to inflate said hood, said opening being sufficient to allow said inflated hood to be placed over the head of the user and expanding said hood to provide an enlarged enclosed volume above the head of the user, whereby said opening may be secured substantially airtight about the neck of the wearer so that the wearer can, for a predetermined time, breathe the air within the hood free of external air.

2. The device according to claim 1, wherein said hood is transparent.

3. The device according to claim 2, wherein said hood is made of plastic.

4. The device according to claim 2, wherein said closure means comprises a drawstring.

5. Apparatus for protection against smoke or other gases, comprising an enlarged hood formed of flexible substantially transparent sheet material impermeable to air, said hood having front and rear panels joined along their side edges by gussets, into a unitarily integral member fully enclosed and sealed said hood having a single opening at the lower end to permit placement of a wearer's head into said hood, said hood being collapsible when not in used into a flat airless packet and distendible by manipulation to allow ambient air to inflate said hood, said opening being sufficient to allow said inflated hood to be placed over the head of the user and expanding said hood to provide an enlarged enclosed volume above the head of the user, said apparatus further having a drawstring closure at the open end for closing said hood about the neck of the wearer thereby allowing the wearer to breathe the air in said hood free of external air.

6. The apparatus according to claim 5, wherein said sheet material is lightweight plastic.

7. The apparatus according to claim 5, wherein the plastic is transparent.

* * * * *

UNITED STATES PATENT AND TRADEMARK OFFICE

CERTIFICATE OF CORRECTION

PATENT NO. : 5,214,803

DATED : June 1, 1993

INVENTOR(S) : David Shichman

It is certified that error appears in the above-identified patent and that said Letters Patent is hereby corrected as shown below:

Column 1, line 52: after "without" change "effective" to --affecting--.

Signed and Sealed this

First Day of February, 1994

Bruce Lehman

*Attest:*

BRUCE LEHMAN

*Attesting Officer*

*Commissioner of Patents and Trademarks*